US006782685B2

(12) United States Patent
Bischofberger et al.

(10) Patent No.: US 6,782,685 B2
(45) Date of Patent: Aug. 31, 2004

(54) APPARATUS FOR PRODUCING A CORE SPUN YARN

(75) Inventors: Jürg Bischofberger, Räterschen (CH); Peter Anderegg, Winterthur (CH); Christian Griesshammer, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 40 days.

(21) Appl. No.: 10/022,811

(22) Filed: Dec. 18, 2001

(65) Prior Publication Data

US 2002/0124543 A1 Sep. 12, 2002

(51) Int. Cl.[7] ..... D02G 3/36; D01M 4/34

(52) U.S. Cl. ..... 57/5; 57/328; 57/333; 57/350

(58) Field of Search ..... 57/5, 328, 331, 57/332, 333, 334, 341, 343, 344, 346, 350, 403

(56) References Cited

U.S. PATENT DOCUMENTS 4,796,340 A 1/1989 Gerhards
5,193,335 A * 3/1993 Mori ..... 57/296
5,528,895 A * 6/1996 Deno ..... 57/328
5,704,204 A 1/1998 Mima et al.
6,314,714 B1 11/2001 Feuerlohn et al.
6,370,858 B1 4/2002 Mori
6,655,122 B2 12/2003 Shigeyama et al.

FOREIGN PATENT DOCUMENTS

DE 19804341 A1 8/1999

* cited by examiner

*Primary Examiner*—John J. Calvert
*Assistant Examiner*—Shaun R Hurley
(74) *Attorney, Agent, or Firm*—Dority & Manning, P.A.

(57) ABSTRACT

An apparatus and method for producing a core spun yarn by means of a fluid delivery device is provided. The apparatus substantially comprises a fiber and thread guide means using a fiber guide conduit with a fiber guide surface for guiding fibers and a thread guide for guiding at least one continuous yarn into an inlet orifice of a yarn guide conduit and a fluid delivery device for producing a swirl flow about the inlet orifice of the yarn guide conduit so that the at least one continuous yarn can be spun over by the fibers. The thread guide is either a groove which is associated with the fiber guide surface, a bore disposed below the fiber guide surface, an individual tube-like element, or a tube-like element that is combined with a groove or a bore. The thread guide is introduced in a fiber and thread guide means, with the axis of the groove, the bore or the tube-like element being in alignment with the axis of the yarn guide conduit.

19 Claims, 7 Drawing Sheets

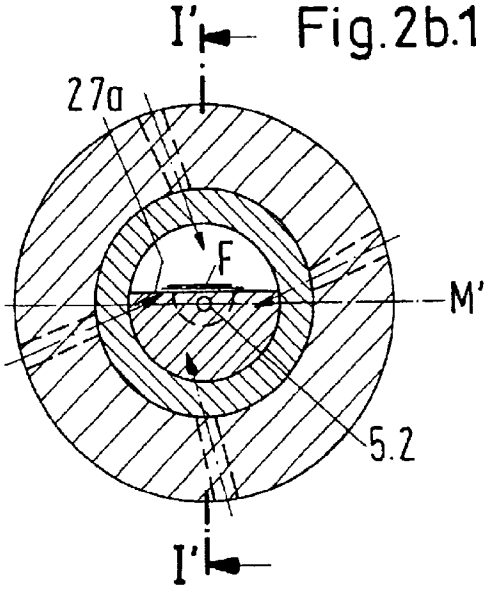
Fig.2b.1
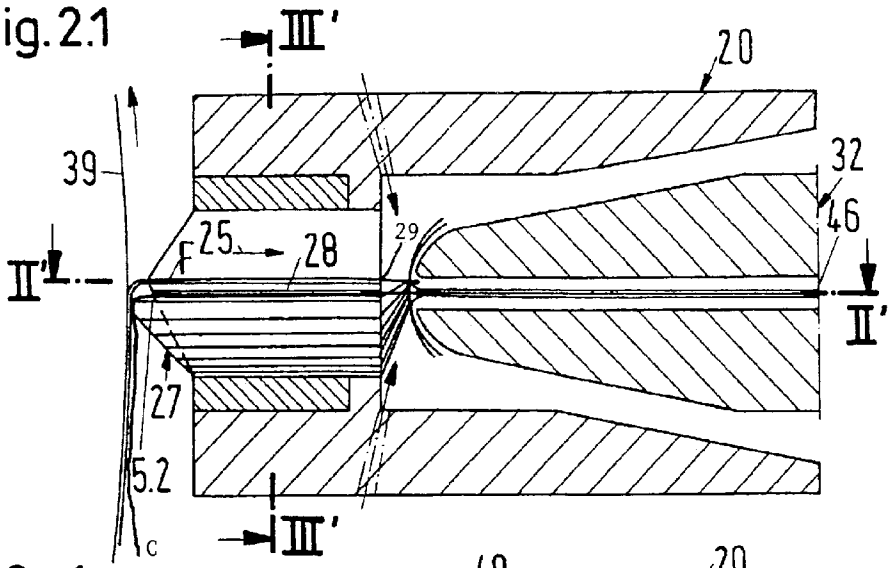
Fig.2.1
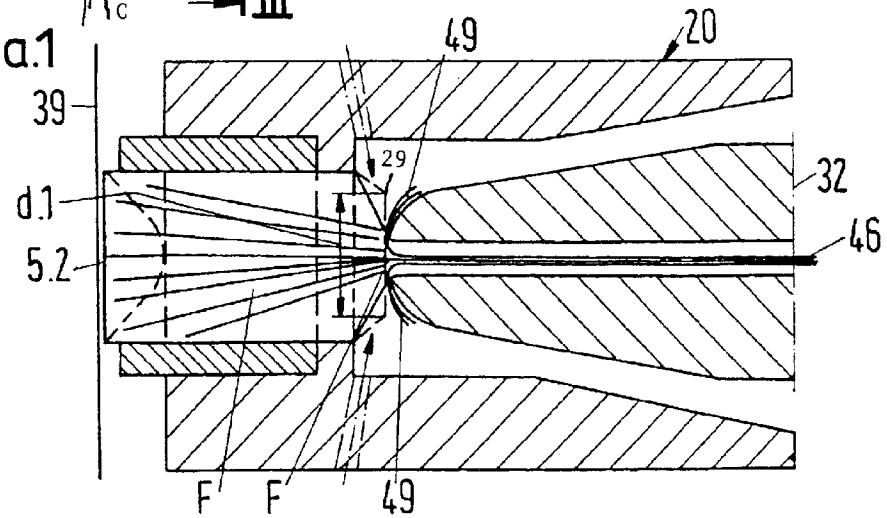
Fig.2a.1

APPARATUS FOR PRODUCING A CORE SPUN YARN

BACKGROUND OF THE INVENTION

The invention relates to an apparatus and a method for producing a spun yarn from a fiber structure which spins over at least one separately supplied continuous thread into a core spun yarn. The apparatus includes a fiber guide conduit with a fiber guide surface for guiding the fibers of the fiber structure, a guide apparatus for guiding the continuous yarn into an inlet orifice of a yarn guide duct, and a fluid device for producing an eddy current around the inlet orifice of the yarn guide conduit. An apparatus for producing a core spun yarn is known from DE 198 04 341. It concerns a ring spinning apparatus with which at least one continuous yarn can be supplied to the drafted silver and is spun together into a yarn. It is not known, however, to produce a core spun yarn by fluid guidance.

An apparatus in which the fibers are guided for the incorporation of the front fiber ends by the rear part of the fibers in a fiber guide and by means of which the fibers can be grasped in this way by the produced air vortex in order to produce an even and strong yarn is described in U.S. Pat. No. 5,528,895. In order to guide the fibers, a pin is provided which is disposed centrically with respect to the yarn guide conduit and about which the supplied fibers extend spirally in the direction towards the yarn guide conduit in order to be spun. This central device prevents the contribution of a continuous yarn, or several thereof, which forcibly need to pass through the center of the yarn guide conduit.

OBJECTS AND SUMMARY OF THE INVENTION

An apparatus for producing a yarn from staple fiber by means of fluid guidance is therefore a principal object of the present invention.

Additional objects and advantages of the invention will be set forth in part in the following description, or may be obvious from the description, or may be learned through practice of the invention.

This principal object is substantially achieved in such a way that a fiber guide surface faces a spindle with a yarn guide conduit, through and by which the fibers are guided in a substantially flat formation in a mutually adjacent way towards the inlet orifice of the yarn guide conduit. The fiber guide element is additionally provided with the fiber guide surface with a guide means incorporated in the thread guide means for the at least one continuous yarn, so that the same can be spun over by the fibers on the spindle.

Further details on the solution and advantageous embodiments are described in the description with the figures. The invention is now explained in closer detail by reference to the drawings merely illustrating possible embodiments.

DETAILED DESCRIPTION

Reference will now be made in detail to the presently preferred embodiments of the invention, one or more of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1A:
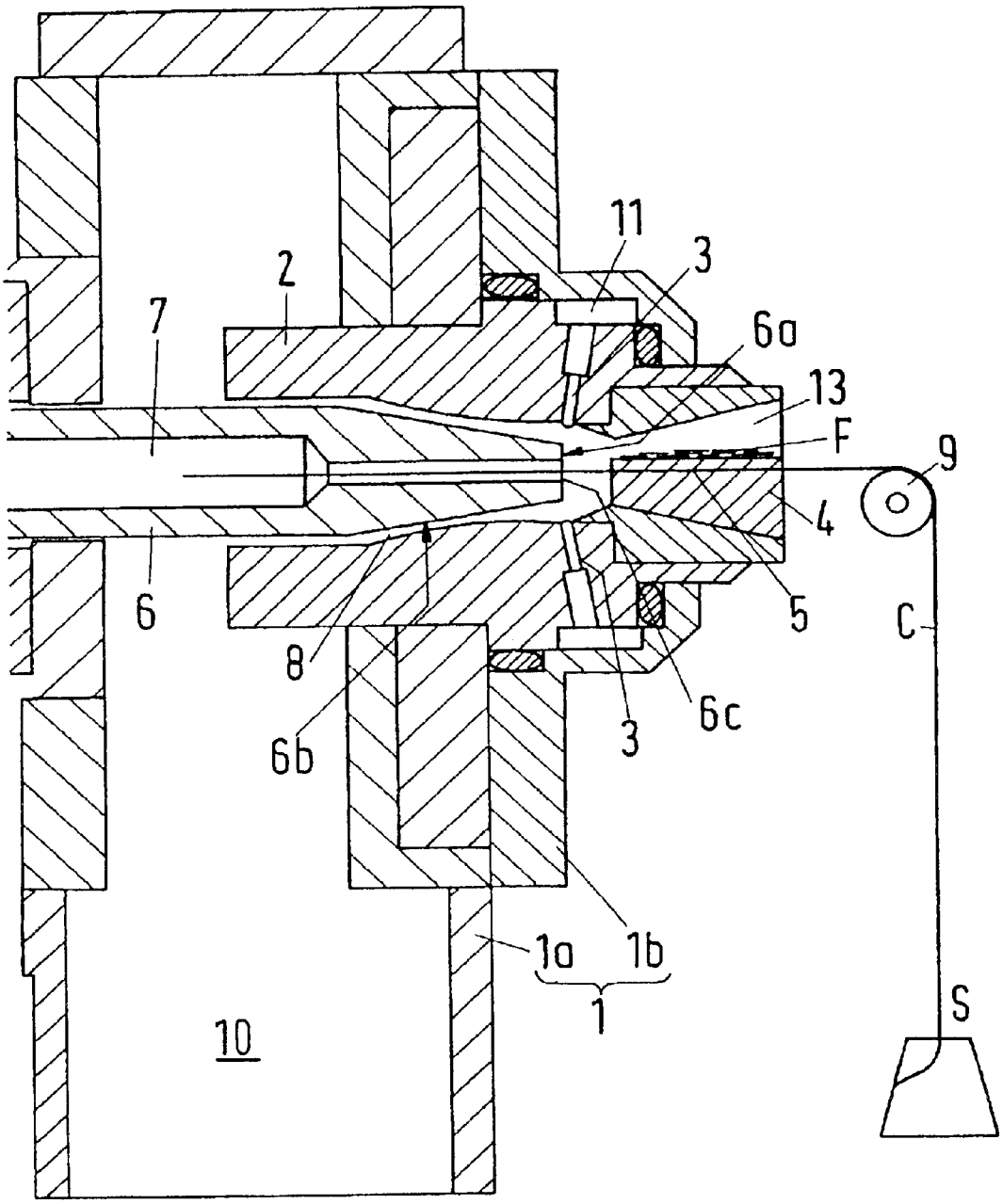
FIGS. 1*a*–1*c* show in sections and in a schematic way the most essential parts of an apparatus for "open-end" core spun yarn production with the supply of a continuous yarn without the supply of the fibers being shown.
Figure 1B:
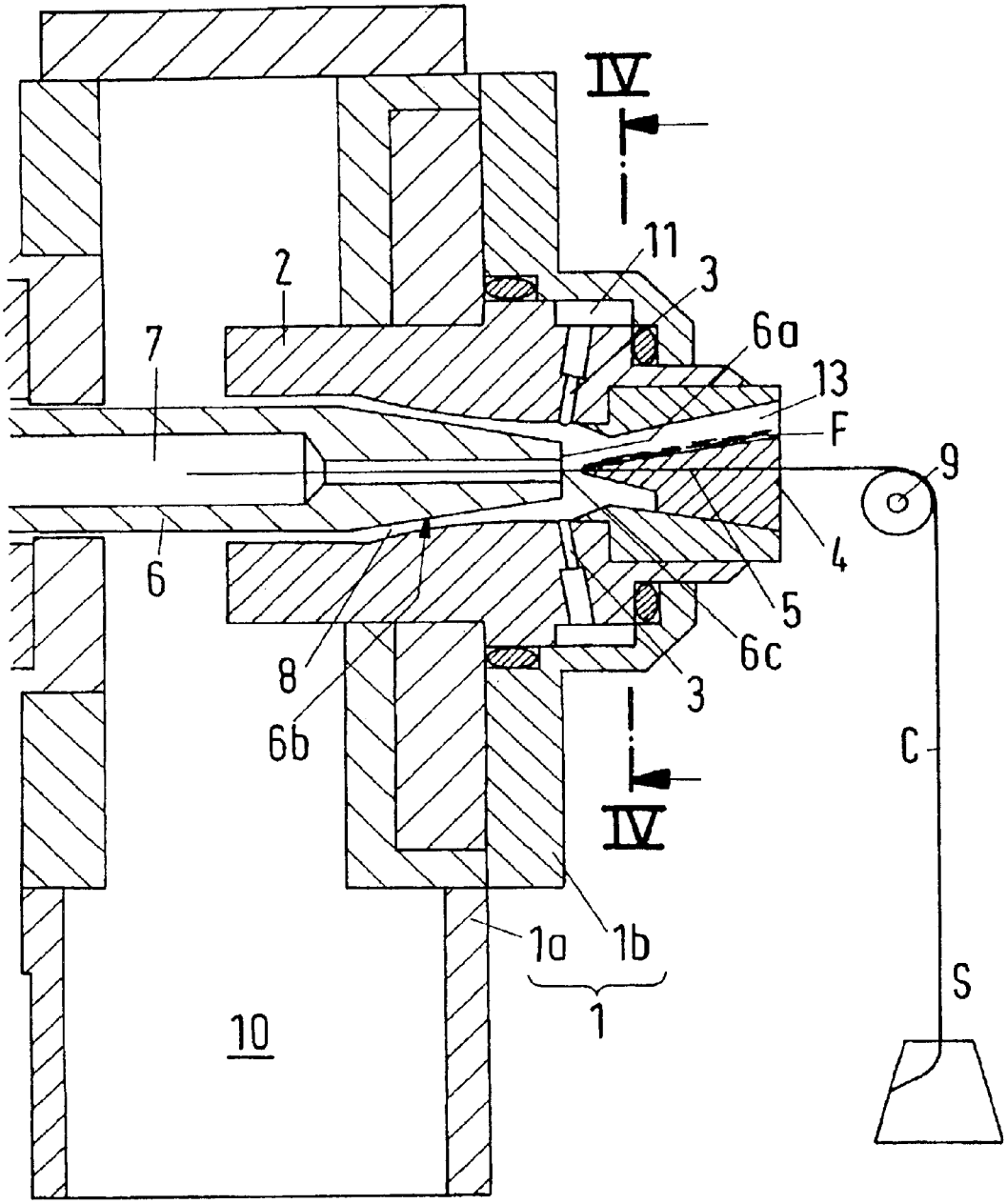
Figure 1C:
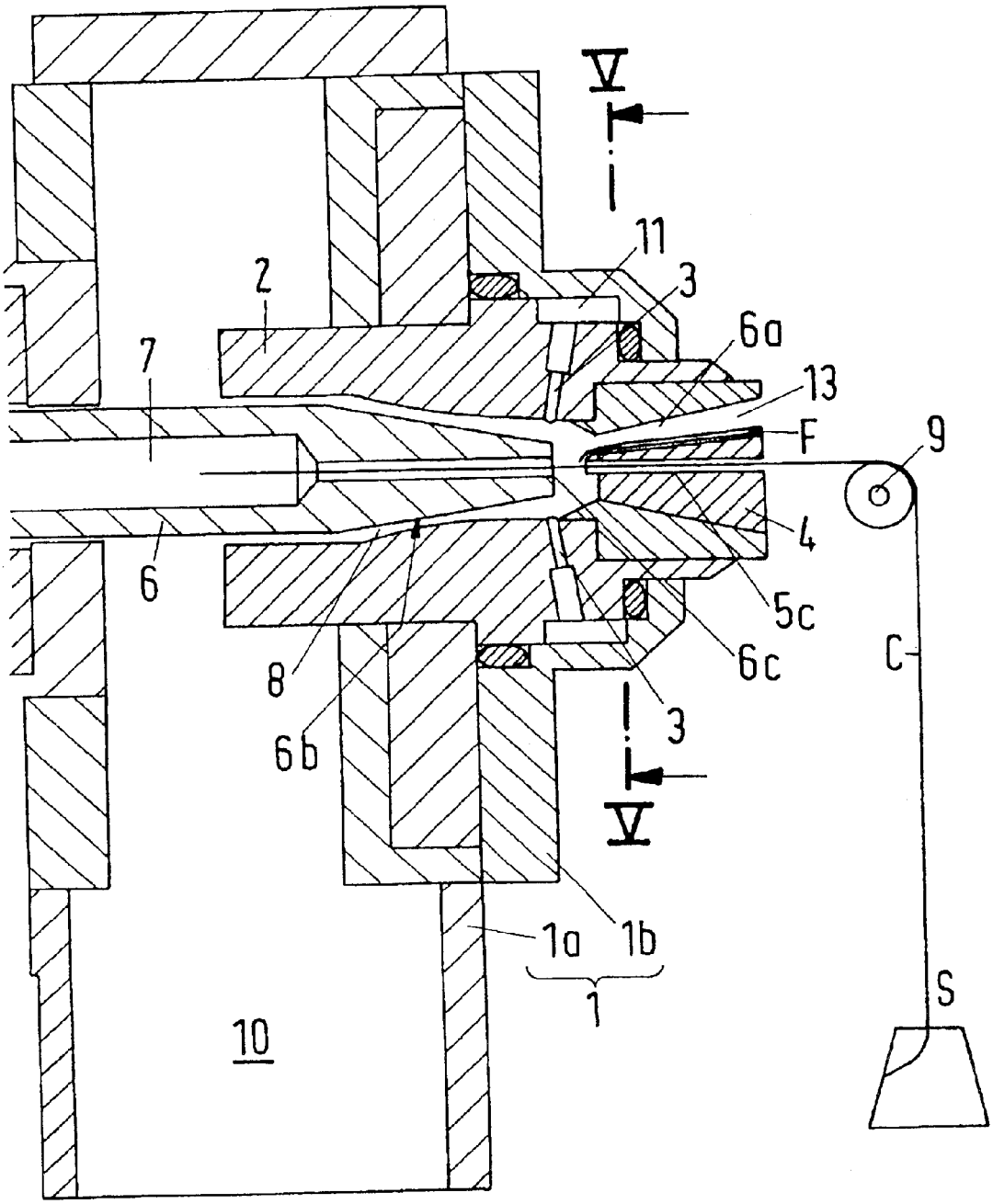

FIG. 1*a*–*c* shows a housing 1 with the housing parts 1*a* and 1*b* with a nozzle block 2 which is built into the same and comprises jet nozzles 3 by means of which the turbulent flow is produced for producing a core spun yarn. FIG. 1*a*–*c* further shows fiber and thread guide means 4, which is drawn in this case with a conveying surface for conveying the fibers F, with a guide means 5 incorporated in the same for a continuous yarn C drawn from a bobbin S via a deflection roller 9. The yarn can be a continuous filament, a staple fiber yarn, or a mono- or multi-filament.

The jet nozzles 3 (or other fluid delivery devices) produce the turbulent flow for the swirl by which the fibers F supplied via the fiber and thread guide means 4 are twisted in a sense of rotation about the face side 6*a* of the so-called spindle 6 and are guided into a yarn guide conduit 7 of the spindle 6. The fibers F are conveyed in a fiber guide conduit 13 on the conveying surface of the fiber and thread guide means 4 as a result of suction air against the face side 6*a* of the spindle 6. The suction air is produced as a result of an injector effect of jet nozzles 3 which are provided in such a way that on the one hand the aforementioned air swirl is produced, but, on the other hand, air is also sucked through the fiber guide conduit 13. The air escapes along a conical part 6*b* of the spindle 6 through a ventilation space 8 into an air outlet 10. The compressed air for the jet nozzles 3 is supplied evenly to the jet nozzles by means of a compressed air distribution chamber 11.

It is discussed further below how the continuous yarn C can be placed in the apparatus. The guide means 5 for the continuous yarn C is aligned in such a way that it is introduced centrically or that the guided continuous yarn C is introduced centrically in the inlet orifice 6*c* of the spindle 6.

The fiber and thread guide means 4 is preferably designed in such a way that the fiber guide surface 28 (see FIG. 2) comes to lie horizontally, as is shown in FIG. 1*a*, or that, instead, the fiber and thread guide means 4 is shaped in a tapering manner towards the face side 6*a* of spindle as shown in FIG. 1*b*, e.g., at all or only some sides. This advantageously leads to the fibers F reaching the inlet orifice 6*c* already in a very central way to the face side 6*a* facing the inlet orifice 6*c*. The guide means 5 incorporated in the fiber and thread guide means 4 can be in both cases a groove for receiving a continuous yarn C or a continuous bore through the fiber and thread guide means 4, through which the continuous yarn C is guided. Instead of sharply shaping the fiber and thread guide means 4 in a sharply tapering way, it is also possible to provide as a further possibility a tube-like element 5*c*, e.g., a small tube provided with a continuous opening, in the fiber and thread guide means 4 (FIG. 1*c*) which is preferably situated closer to the inlet orifice 6*c* and by means of which the continuous yarn C is guided in a centrical way to the inlet orifice 6*c*. If the tube-like element 5*c* is only a part of the guide means 5, the remaining guide means 5 in the thread guide means 4 can be arranged as a groove or bore. If the fiber and thread guide means 4 is provided with an arrangement tapering towards the face side 6*a* of the spindle 6 or with a tube-like element 5*c*, the fibers F are very centrically aligned towards the yarn guide conduit 7 already at the end of the fiber and thread guide means 4 or the tube-like element 5*c*.

Figures 2, 2A, 2B, 2C:
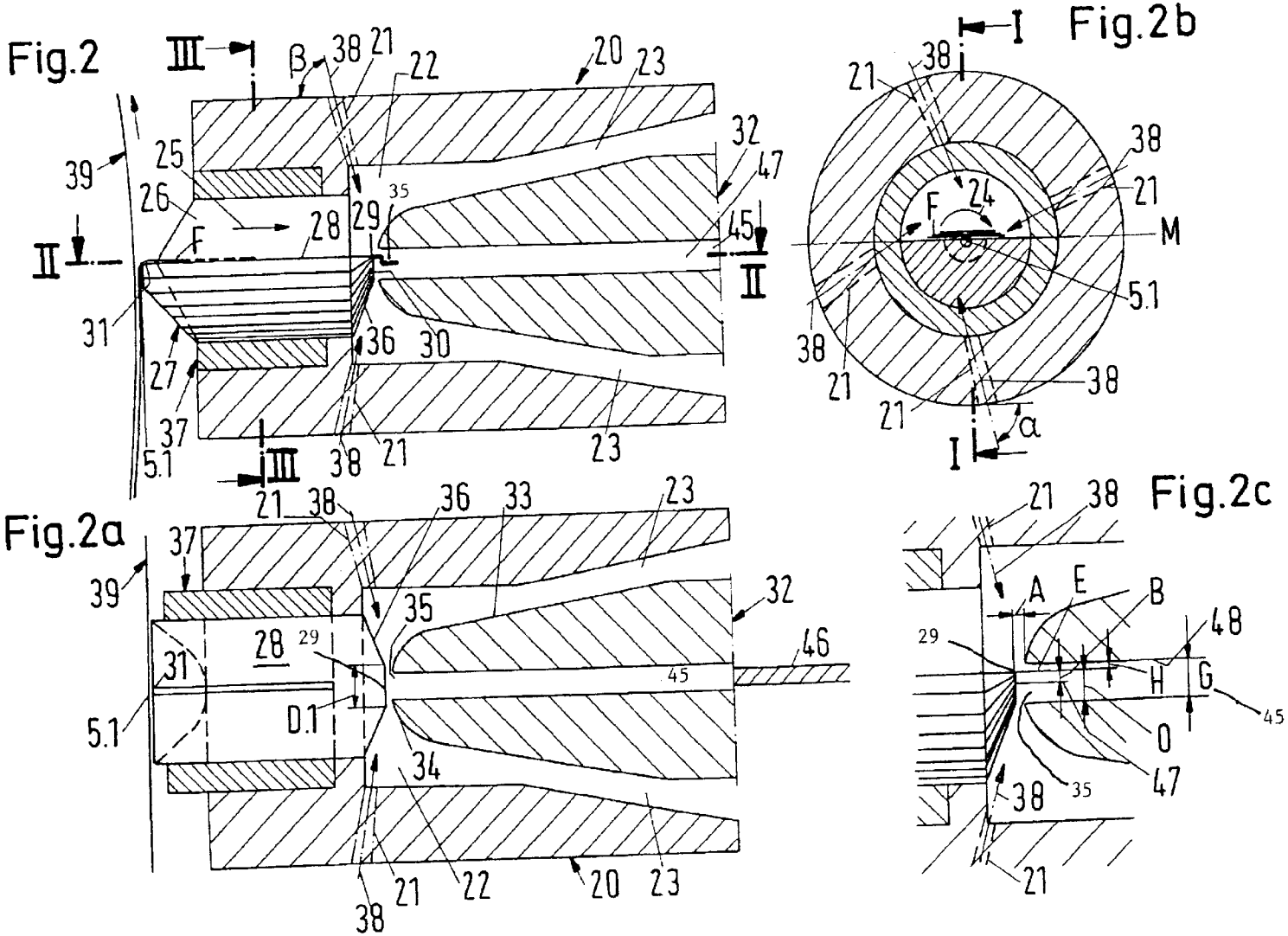
FIGS. 2, 2.1 show the invention according to FIGS. 1*a* and 1*b* substantially according to the lines of intersection I—I (FIG. 2*b*) and the lines of intersection I'—I' in FIG. 2*b*.1, with a middle element being shown in a non-sectional manner.
FIGS. 2*a*, 2*a*.1 show a sectional view according to the lines of intersection II—II of FIG. 2 and II'—II' of FIG. 2.1.
FIGS. 2*b*, 2*b*.1 show a cross-sectional view according to the lines of intersection III—III of FIG. 2 and III'—III' of FIG. 2.1.
FIG. 2*c* shows a sectional view of FIG. 2, enlarged.

FIGS. 2, 2*a* and 2*c* show a fiber delivery edge 29 which is situated very close to an inlet orifice 35 of a yarn guide conduit 45 which is disposed within a so-called spindle 32. Advantageously, the fiber delivery edge 29 is disposed with a predetermined distance A between the same and the inlet orifice 35 as well as a predetermined distance B between a central line 47 of the yarn guide conduit 45 and an imaginary plane E, which plane E contains the edge and is parallel to the central line 47 (as shown in FIG. 2*c*).

The distance A corresponds depending on the type of fiber and mean fiber length and the respective experimental results to a range of 0.1 to 1.0 mm. The distance B depends on a diameter G of the yarn guide conduit 45 and lies, depending on the results of the trials, within a range of 10 to 30% of the diameter G.

Furthermore, the fiber delivery edge 29 is provided with a length D.1 (FIG. 2*a*) which is at a ratio of 1:5 of the diameter G of the yarn guide conduit 45 and is formed by a face side 30 of a fiber conveying element 27 (according to the fiber and thread guide means 4) and a fiber guide surface 28 of the element 27. The face side 30, with its height O, is situated within the range of diameter G and is provided with an empirically determined distance H between the plane E and the opposite inner wall 48 of the yarn guide conduit 45. If the fiber and thread guide means 4 is arranged, as in FIG. 1*b*, tapering towards the face side 6*a* of the spindle 6 or as in FIG. 1*c* with a tube-like element 5*c*, all distances need to be determined empirically in a respective way.

The fiber conveying element 27 is provided with a guide means 5.1 (one groove, FIG. 2*b*) or 5.2 (a bore, FIG. 2*b*.1) for guiding the continuous yarn C and resides in a supporting element 37 received in the nozzle block 20. The fiber conveying element 27 forms with this supporting element 37 a free space defining the fiber guide conduit 26. Furthermore, the fiber conveying element 27 is provided at the entrance with a fiber receiving edge 31 about which the fibers are guided that a fiber conveying roller 39 supply. These fibers are lifted off from the fiber conveying roller 39 by means of a suction air flow and conveyed. through the fiber guide conduit 26. The suction air flow is produced by an air flow produced in jet nozzles 21 (or other fluid delivery devices) with a blowing direction 38 as a result of an injector effect.

The nozzle jets 21 are, as shown in FIGS. 2 and 2*b*, positioned in an inclined manner in a nozzle block 20 with an angle β on the one hand in order to produce the injector effect and with an angle a on the other hand in order to produce an air swirl. The air swirl rotates with a direction of rotation 24 along a cone 36 of the fiber conveying element 27 and about the front surfaces 34 of the spindle in order to form, as will be explained below, a yarn in the yarn guide conduit 45 of the spindle 32. The fiber guide surface 28 is provided in the direction of fiber guidance with a recess 5.1 for guiding the continuous yarn C (FIG. 2*a* from above, FIG. 2*b* in a sectional view). The endless yarn C is placed in the recess 5.1 and thereafter spun over by the fibers F.

The air flow produced by nozzles 21 in a swirl chamber 22 escapes to the atmosphere along a spindle cone 33 through a ventilation conduit 23 formed about the so-called spindle 32 (no. 6 in FIG. 1*a*–*c*) or to a suction device. In order to form a core spun yarn 46, the fibers supplied by the fiber conveying roller 39 are lifted off from the fiber conveying roller 39 by means of the suction air stream in the fiber guide conduit 26 as has already been mentioned and are guided on the fiber guide surface 28 in a conveying direction 25 together with the continuous yarn C towards the fiber delivery edge 29. From the delivery edge, the ends of the fibers are guided through the spindle inlet orifice 35 into the yarn guide conduit 45, whereas the other second ends 49 (as seen in FIG. 2*a*.1) of the fibers flip over once the second ends are free and are grasped by the rotating air flow. During the further conveyance of the fibers in the yarn guide conduit 45 about the endless yarn C, a core spun yarn 46 is thus produced which has a yarn character similar to a ringspun yarn.

This process is also shown similarly in the FIGS. 2.1 through 2*b*.1. It is shown that the fibers F supplied with the fiber conveying roller 39 are guided together with the continuous yarn C (FIG. 2.1 from the side; FIG. 2*b*.1 in a sectional view) which is guided through a bore 5.2 in the fiber conveying element 27 in the conveying direction 25 on the fiber guide surface 28 towards the fiber delivery edge 29 namely—as is shown in FIG. 2*a*.1—by means of a converging fiber flow which is continually constricted towards the inlet orifice 35. This constriction is made for the reason that the ends which are at the front as seen in the running direction of the fibers and are already incorporated in the twisted yarn 46 have the tendency to migrate in the direction towards the constriction, so that the further backwardly disposed second ends of the fibers are also displaced in the direction towards the constriction. This only occurs until the second ends 49 of the fibers F are grasped by the air swirl in order to be turned about the front surface 34 of the spindle and are pulled with the yarn draw-off speed into the inlet orifice 35 and are provided with the twist required for the yarn formation.

In FIG. 2*a*.1, the width d.1 is shown enlarged by means of dot-dash line. This is to show on the one hand that this width can be enlarged and to illustrate on the other hand that the enlarged width d.1 reduces the swirl chamber 22 as shown in FIG. 2*a* under certain circumstances. This enlargement may even disturbingly change the swirl chamber 22 in that the swirl flow can no longer develop in such a way that the fiber ends 49 can be grasped with the desired energy by the swirl flow. This width needs to be determined with empirical trials.

The aforementioned yarn formation occurs after the beginning of a piecing process of any kind. For example, a yarn end of an already existing yarn is guided back through the yarn guide conduit 45 to the zone of the spindle inlet orifice 35 in a manner that fibers of the yarn end are opened by the already rotating air flow to such a wide extent that ends of fibers newly supplied through the fiber guide conduit 26 can be grasped by this rotating fiber structure. By a renewed draw-off of the introduced yarn end, the following parts of the newly supplied fibers which are already able to wind around the ends disposed in the orifice part of the yarn guide conduit, are entrained, so that subsequently the yarn can be newly spun with a substantially predetermined piecing. At the beginning of the piecing process, it is possible with the proposed apparatus to shoot in the continuous yarn C from one end of the spinning apparatus through the fiber and thread guide means 4 and through the yarn guide conduit 45, so that is grasped at the other end and can be attached to a wound lap, for example. Apparatuses are described further below by reference to schematic representations with which the shooting and the insertion process can be simplified substantially.

The fiber guide surface 28 or the fiber delivery edge 29 can be shaped differently, e.g., concavely, convexly or waved. These shapes are used for the different fiber guidance on the fiber guide surface 28 and must be determined empirically depending on the type of fiber and the fiber length. It has been noticed that concave is suitable for so-called "slippery" fibers and convex for so-called "adhesive" fibers. "Slippery" fibers are understood as being those which have a low mutual adhesion and "adhesive" fibers are those which have a stronger mutual adhesion.

Figure 3A:
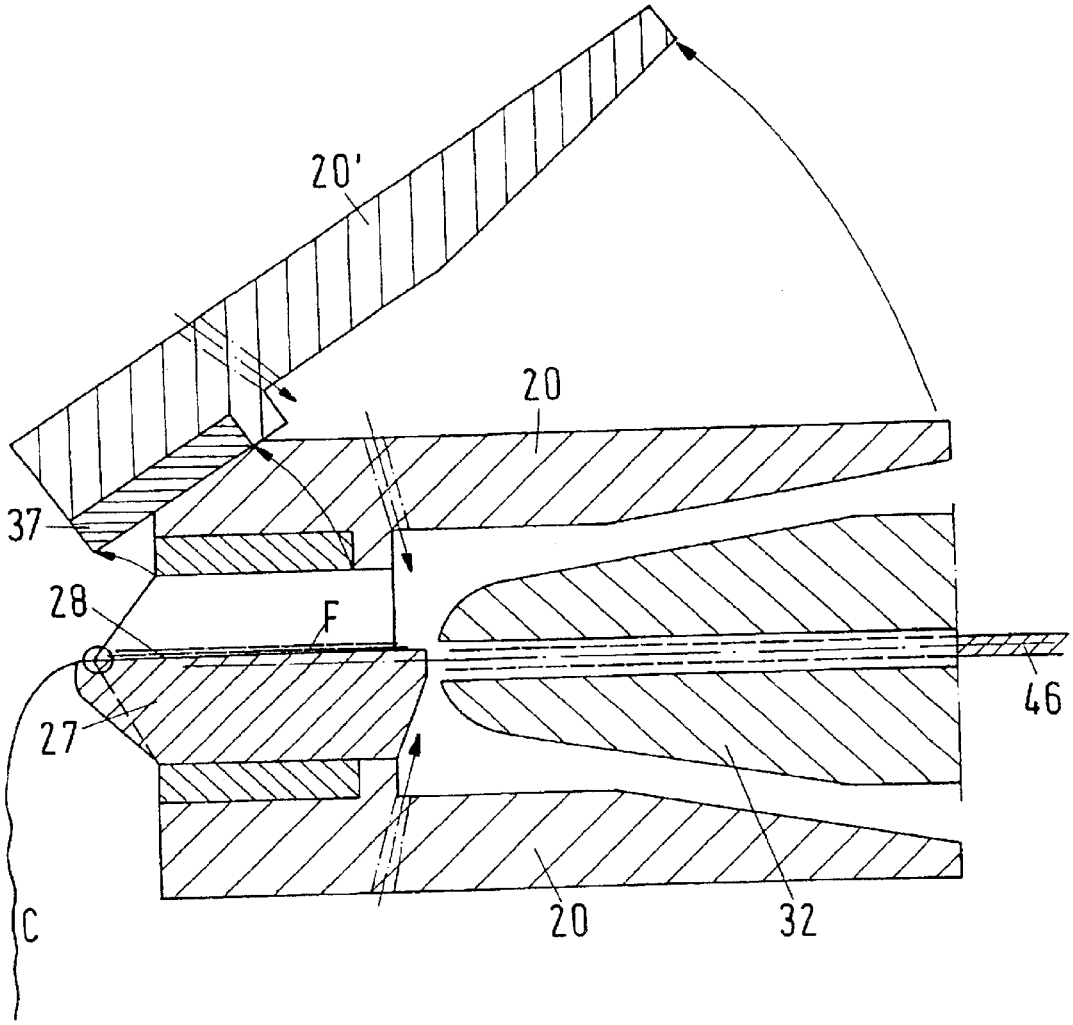
FIG. 3*a*, 3*b* show proposals for apparatuses for inserting the continuous yarn in connection with FIGS. 2 and 2*b* in a schematic representation.
Figure 3B:
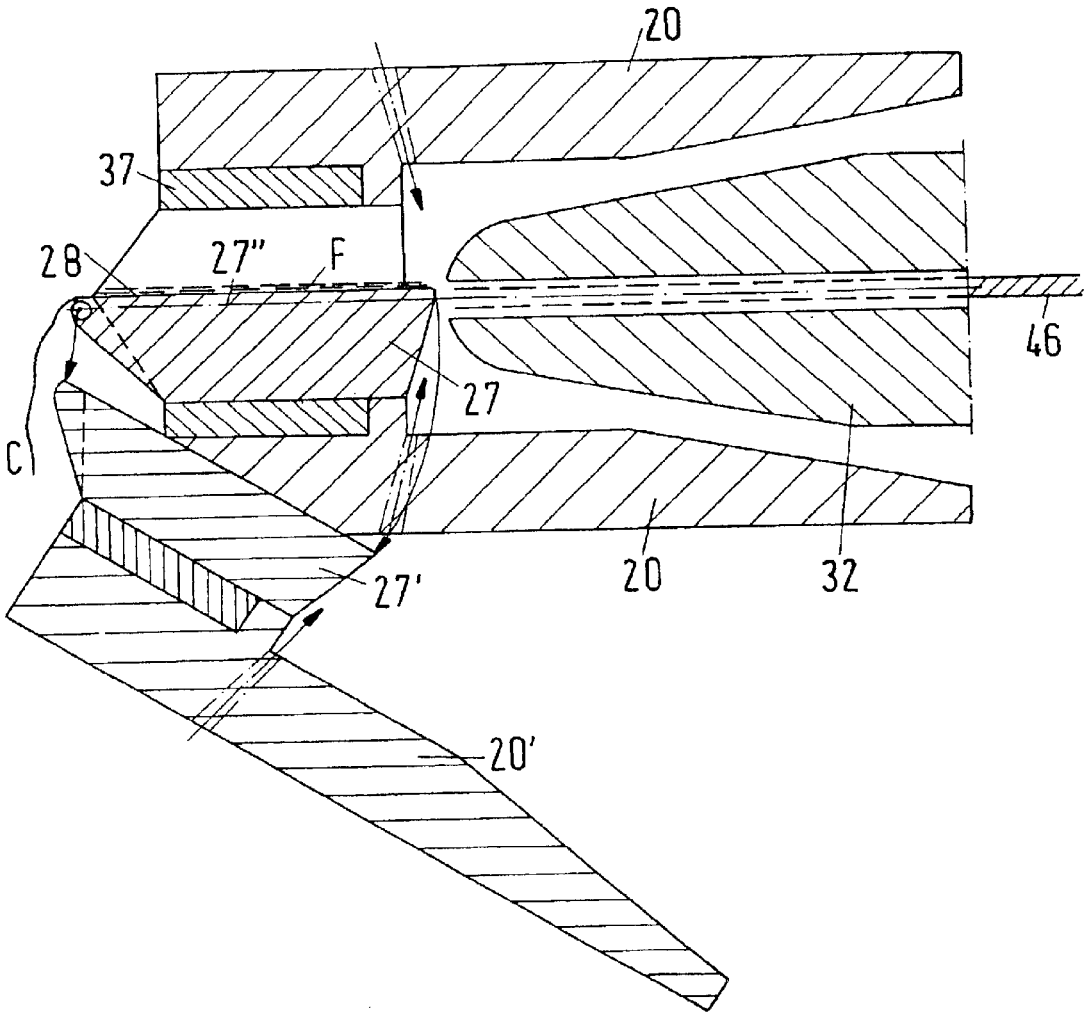

FIGS. 3*a* and 3*b* show an embodiment for a solution for modifying the above apparatus (FIGS. 2–2*c*) for the insertion of the continuous yarn C prior to piecing. The FIGS. 3*a*–*b* show a nozzle block 20 according to the FIGS. 2 and 2.1. In FIG. 3*a*, a part 20' of the nozzle block 20 including the supporting element 37 can be flipped open along line M according to FIG. 2*b* and can be lifted off in such a way that the fiber guide surface 28 and the groove 5.1 which is introduced therein are freely accessible. A continuous yarn C for producing a core spun yarn can be inserted with ease without having to thread the same through groove 5.1. In the case of guide means 5 in form of a bore 5.2, a part of the fiber conveying elements 27', as is schematically shown in FIG. 3*b*, is flipped downwardly along line M' according to FIG. 2*b*.1. Bore 5.2 is thus uncovered, and continuous yarn C can be inserted. In the case of a tube-like element 5*c* which is inserted into the fiber and thread guide means 4 and is shorter than the fiber and thread means 4, an upper or lower part of the nozzle block 20 is flipped away according to the groove 5.1 or bore 5.2 remaining on the length of the fiber guide and thread means 4. As a result of the tube like element 5*c*, it is necessary to thread or shoot in a continuous yarn C according to conventional technique. The path is reduced by a short tube-like element which is shorter than the fiber guide and thread means 4 and in the two other cases the shooting-in process can be omitted completely.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A core spun apparatus for producing at least one continuous yarn and a plurality of fibers into a core spun yarn, said apparatus comprising:

a spindle defining a yarn guide conduit and an inlet orifice of said yarn guide conduit;

a thread guide operably disposed proximal to said inlet orifice of said yarn guide conduit defined by said spindle, said thread guide directing a continuous yarn into said yarn conduit defined by said spindle;

a fiber guide operably disposed to said thread guide proximal to said inlet orifice of said yarn guide conduit defined by said spindle, said fiber guide forming a fiber guide conduit through which fibers are supplied to said inlet orifice of said yarn guide conduit defined by said spindle;

a fiber guide surface disposed within said fiber guide conduit defined by said fiber guide, said fiber guide surface directing said fibers to said inlet orifice of said yarn guide conduit defined by said spindle; and a fluid delivery device carried within said core spun apparatus, said fluid delivery device supplying a fluid proximal to said yarn conduit causing a swirl flow around said inlet orifice of said yarn guide conduit defined by said spindle.

2. A core spun apparatus as in claim 1, further comprising a fiber delivery edge integral to said fiber guide surface on said end of said fiber guide conduit of said fiber guide proximal to said inlet orifice of said yarn guide conduit defined by said spindle.

3. A core spun apparatus as in claim 1, wherein said fiber guide and said thread guide taper from a wide end distal from said inlet orifice of said yarn guide conduit defined by said spindle to a narrower end proximal to said inlet orifice of said yarn guide conduit defined by said spindle.

4. A core spun apparatus as in claim 1, wherein said thread guide includes a tube element for directing said continuous yarn to said yarn guide conduit defined by said spindle.

5. A core spun apparatus as in claim 1, wherein said fluid delivery device is at least one air jet.

6. A core spun apparatus as in claim 1, wherein said fluid delivery device is positioned in an incincd incline relative to an axis of said yarn guide conduit defined by said spindle.

7. A core spun apparatus as in claim 1, wherein said fluid delivery device creates suction through said fiber guide conduit defined by said fiber guide.

8. A core spun apparatus for producing at least one continuous yarn and a plurality of fibers into a core spun yarn, said apparatus comprising:

a spindle defining a yarn guide conduit and an inlet orifice of said yarn guide conduit;

a thread guide operably disposed proximal to said inlet orifice of said yarn guide conduit defined by said spindle, said thread guide directing a continuous yarn into said yarn conduit defined by said spindle;

a fiber guide operably disposed to said thread guide proximal to said inlet orifice of said yarn guide conduit defined by said spindle, said fiber guide forming a fiber guide conduit through which fibers are supplied to said inlet orifice of said yarn guide conduit defined by said spindle;

a fiber guide surface disposed within said fiber guide conduit defined by said fiber guide, said fiber guide surface directing said fibers to said inlet orifice of said yarn guide conduit defined by said spindle;

a fluid delivery device carried within said core spun apparatus, said fluid delivery device supplying a fluid proximal to said yarn conduit causing a swirl flow around said inlet orifice of said yarn guide conduit defined by said spindle; and wherein said thread guide defines a bore for directing said continuous yarn to said yarn guide conduit defined by said spindle, said bore extending below said fiber guide surface and having an axis converging proximally with an axis of said yarn guide conduit defined by said spindle so that said bore and said yarn guide conduit are in alignment.

9. A core spun apparatus for producing at least one continuous yarn and a plurality of fibers into a core spun yarn, said apparatus comprising:

a spindle defining a yarn guide conduit and an inlet orifice of said yarn guide conduit;

a thread guide operably disposed proximal to said inlet orifice of said yarn guide conduit defined bv said spindle, said thread guide directing a continuous yarn into said yarn conduit defined bv said spindle;

a fiber guide operably disposed to said thread guide proximal to said inlet orifice of said yarn guide conduit defined by said spindle, said fiber guide forming a fiber guide conduit through which fibers are supplied to said inlet orifice of said yarn guide conduit defined by said spindle;

a fiber guide surface disposed within said fiber guide conduit defined bv said fiber guide, said fiber guide surface directing said fibers to said inlet orifice of said yarn guide conduit defined by said spindle;

a fluid delivery device carried within said core spun apparatus, said fluid delivery device supplying a fluid proximal to said yarn conduit causing a swirl flow around said inlet orifice of said yarn guide conduit defined by said spindle; and wherein said thread guide defines a groove for directing said continuous yarn to said yarn guide conduit defined by said spindle, said groove incorporated within said fiber guide surface and having an axis converging proximally with an axis of said yarn guide conduit defined by said spindle so that said groove and said yarn guide conduit are in alignment.

10. A core spun apparatus for producing at least one continuous yarn and a plurality of fibers into a core spun yarn, said apparatus comprising:

a spindle defining a yarn guide conduit and an inlet orifice of said yarn guide conduit;

a thread guide operably disposed proximal to said inlet orifice of said yarn guide conduit defined by said spindle, said thread guide directing a continuous yarn into said yarn conduit defined by said spindle;

a fiber guide operably disposed to said thread guide proximal to said inlet orifice of said yarn guide conduit defined by said spindle, said fiber guide forming a fiber guide conduit through which fibers are supplied to said inlet orifice of said yarn guide conduit defined by said spindle;

a fiber guide surface disposed within said fiber guide conduit defined by said fiber guide, said fiber guide surface directing said fibers to said inlet orifice of said yarn guide conduit defined by said spindle;

a fluid delivery device carried within said core spun apparatus, said fluid delivery device supplying a fluid proximal to said yarn conduit causing a swirl flow around said inlet orifice of said yarn guide conduit defined by said spindle; and wherein said apparatus is openable and closable along an axis of said thread guide to allow insertion of said continuous yarn.

11. A core spun apparatus as in claim 10, wherein an upper portion of said thread guide is openable and closable.

12. A core spun apparatus as in claim 10, wherein a lower portion of said thread guide is openable and closable.

13. A core spun apparatus for producing at least one continuous yarn and a plurality of fibers into a core spun yarn, said apparatus comprising:

a spindle defining a yarn guide conduit and an inlet orifice of said yarn guide conduit;

a thread guide operably disposed proximal to said inlet orifice of said yarn guide conduit defined by said spindle, said thread guide directing a continuous yarn into said yarn conduit defined by said spindle;

a fiber guide operably disposed to said thread guide proximal to said inlet orifice of said yarn guide conduit defined by said spindle, said fiber guide forming a fiber guide conduit through which fibers are supplied to said inlet orifice of said yarn guide conduit defined by said spindle;

a fiber guide surface disposed within said fiber guide conduit defined by said fiber guide, said fiber guide surface directing said fibers to said inlet orifice of said yarn guide conduit defined by said spindle;

a fluid delivery device carried within said core spun apparatus, said fluid delivery device supplying a fluid proximal to said yarn conduit causing a swirl flow around said inlet orifice of said yarn guide conduit defined by said spindle; and wherein said fiber guide surface possesses a convex shape.

14. A core spun apparatus for producing at least one continuous yarn and a plurality of fibers into a core spun yarn, said apparatus comprising:

a spindle defining a yarn guide conduit and an inlet orifice of said yarn guide conduit;

a thread guide operably disposed proximal to said inlet orifice of said yarn guide conduit defined by said spindle, said thread guide directing a continuous yarn into said yarn conduit defined by said spindle;

a fiber guide operably disposed to said thread guide proximal to said inlet orifice of said yarn guide conduit defined bv said spindle, said fiber guide forming a fiber guide conduit through which fibers are supplied to said inlet orifice of said yarn guide conduit defined by said spindle;

a fiber guide surface disposed within said fiber guide conduit defined by said fiber guide, said fiber guide surface directing said fibers to said inlet orifice of said yarn guide conduit defined by said spindle;

a fluid delivery device carried within said core spun apparatus, said fluid delivery device supplying a fluid proximal to said yarn conduit causing a swirl flow around said inlet orifice of said yarn guide conduit defined by said spindle; and wherein said fiber guide surface possesses a concave shape.

15. A core spun apparatus for producing at least one continuous yarn and a plurality of fibers into a core spun yarn, said apparatus comprising:

a spindle defining a yarn guide conduit and an inlet orifice of said yarn guide conduit;

a thread guide operably disposed proximal to said inlet orifice of said yarn guide conduit defined bv said spindle, said thread guide directing a continuous yarn into said yarn conduit defined by said spindle;

a fiber guide operably disposed to said thread guide proximal to said inlet orifice of said yarn guide conduit defined by said spindle, said fiber guide forming a fiber guide conduit through which fibers are supplied to said inlet orifice of said yarn guide conduit defined by said spindle;

a fiber guide surface disposed within said fiber guide conduit defined by said fiber guide, said fiber guide surface directing said fibers to said inlet orifice of said yarn guide conduit defined by said spindle;

a fluid delivery device carried within said core spun apparatus, said fluid delivery device supplying a fluid proximal to said varn conduit causing a swirl flow around said inlet orifice of said yarn guide conduit defined by said spindle; and wherein said fiber guide surface possesses an oscillating shape.

16. A method for spinning at least one continuous yarn and a pluralities of fibers into a core spun yarn, said method comprising of the steps of:

supplying a continuous yarn and fibers to a core spun apparatus;

directing said fibers toward an inlet of a yarn conduit defined within a spindle of said core spun apparatus;

directing said continuous yarn towards said inlet of said yarn conduit defined within said spindle; and creating a swirl flow of fluid around said inlet of said yarn conduit defined within said spindle causing said fibers to constrict around said continuous yarn forming said core spun yarn.

17. A method as in claim 16, further comprising piecing said continuous yarn into said core spun apparatus to begin spinning said core spun yarn.

18. A method as in claim 17, wherein said step of piecing includes shooting said continuous yarn into a thread guide of said core spun apparatus.

19. A method as in claim 17, wherein said step of piecing includes placing said continuous yarn into a thread guide of said core spun apparatus.

* * * * *

UNITED STATES PATENT AND TRADEMARK OFFICE

CERTIFICATE OF CORRECTION

PATENT NO. : 6,782,685 B2 
DATED : August 31, 2004
INVENTOR(S) : Jurg Bischofberger, Peter Anderegg and Christian Griesshammer It is certified that error appears in the above-identified patent and that said Letters Patent is hereby corrected as shown below:

Column 6,
Lines 1-4, correct to read as follows:
A fiber guide surface disposed within said fiber guide conduit defined by said fiber guide, said fiber guide surface directing said fibers to said inlet orifice of said yarn guide conduit defined by said spindle, said fiber guide surface separate from said thread guide; and Signed and Sealed this Twenty-sixth Day of April, 2005

JON W. DUDAS
*Director of the United States Patent and Trademark Office*